US006178955B1

(12) United States Patent
Yoshida

(10) Patent No.: US 6,178,955 B1
(45) Date of Patent: Jan. 30, 2001

(54) FUEL IMPROVING METHOD AND APPARATUS

(76) Inventor: Isao Yoshida, 2313-1, Owakicho, Yokaichi-shi, Shiga 527-0091 (JP)

( * ) Notice: Under 35 U.S.C. 154(b), the term of this patent shall be extended for 0 days.

(21) Appl. No.: 09/355,876

(22) PCT Filed: Dec. 3, 1998

(86) PCT No.: PCT/JP98/05447

§ 371 Date: Mar. 7, 2000

§ 102(e) Date: Mar. 7, 2000

(87) PCT Pub. No.: WO99/28613

PCT Pub. Date: Oct. 6, 1999

(30) Foreign Application Priority Data

Mar. 12, 1997 (JP) ..... 9-333172

(51) Int. Cl.[7] ..... F02M 27/00
(52) U.S. Cl. ..... 123/538
(58) Field of Search ..... 123/536, 537, 123/538, 539

(56) References Cited

U.S. PATENT DOCUMENTS 3,678,908 * 7/1972 Ito ..... 123/539
4,205,959 * 6/1980 Ito ..... 44/50
6,050,247 * 4/2000 Ichimura ..... 123/536

FOREIGN PATENT DOCUMENTS

06159167 * 7/1994 (JP) .

* cited by examiner

*Primary Examiner*—Marguerite McMahon
(74) *Attorney, Agent, or Firm*—J.C. Patents; Jiawei Huang

(57) ABSTRACT

A method of improving fuel efficiency of an internal combustion engine such as an automobile and controlling exhaust emission, comprising the steps of accommodating a chemical element conversion substance including an Inoue ore produced in the vicinity of Nango of Seta River at the southernmost part of the Lake Biwa and natural radioactive ores such as neutrons and gamma-rays in a fuel strainer of a fluid passageway (1), allowing a fuel such as gasoline or light oil to flow through this passageway (1) and irradiating the fuel with radioactive rays to improve the fuel.

2 Claims, 8 Drawing Sheets

FUEL IMPROVING METHOD AND APPARATUS

TECHNICAL FIELD

The present invention relates to a fuel improving method and apparatus for improving fuel efficiency of a fuel such as gasoline, light oil, LPG, or the like, and reducing hazardous components in exhaust gases, by using a chemical element conversion substance including a kind of granite spontaneously radiating neutrons or gamma-rays, a so-called "Inoue ore" produced in the vicinity of Nango of Seta River at the southernmost part of the Lake Biwa, or a chemical element conversion substance including an ore spontaneously radiating neutrons or gamma-rays produced in other districts in the like manner.

BACKGROUND TECHNOLOGY

In these years, pollution by exhaust emission of automobiles has been becoming the social problems, and a variety of technology to compete with the problems with the pollution by exhaust emission is being developed in each industry sector. Examples of such technology include catalyst purification systems for exhaust gases, a new type diesel engine, direct blast gasoline engine, and so on. Virtually nothing, however, has been reviewed on measures to compete with exhaust emission from existing automobiles, and no measures have currently been taken against an explosive increase in the number of automobiles particularly in the developing countries.

On the other hand, Japanese Patent Unexamined Publication No. 8-218,956 proposes a unique technology about an intake apparatus of an internal combustion engine. This technology is designed to apply a substance containing an alpha-decaying radioactive isotope to an intake system for an internal combustion engine. This technology comprises converting nitrogen in air into oxygen and hydrogen by irradiating intake air with alpha-particles, so that it can raise the temperature of oxygen in a combustion chamber and utilize hydrogen as a portion of fuel, thereby achieving improvements in fuel economy and purification of exhaust emission.

The prior art technology utilizes a substance that spontaneously emits alpha-particles. There is none of naturally-occurring substances but very few that can spontaneously emit alpha-particles; however, the amount of emission of the alpha-particles is extremely small and a large majority of the substances can emit only one alpha-particle or less at the very most for one minute. Therefore, emission of alpha-particles in such a small amount could not be practically applied for improvements in fuel mileage and purification of exhaust emission, so that for that reason it has come to the conclusion that the above Japanese patent application was abandoned on Aug. 30, 1996.

DISCLOSURE OF THE INVENTION

As a result of extensive studies, it has now been found that a particular ore produced in an area in the vicinity of Nango of Seta River at the southernmost part of the Lake Biwa can achieve extraordinary effects of improving fuel economy and purification of exhaust emission of an automobile. The present invention has been completed on the basis of this finding.

The particular ore is one kind of granite which is produced in an area mainly in the vicinity of Nango and Ishiyama of Seta River at the southernmost part of the Lake Biwa (in the southern district of Otsu city), and its composition (by dry weight) is: $SiO_2$=56.8%; $K_2O$=3.2%; MgO=0.12%; $Al_2O_3$=28.8%; $Fe_2O_3$=5.4%; and Ca and others=5.68%. This ore is so called "Inoue ore" after a Mr. Taro Inoue at 158, Hiratsu-machi, Otsu-shi, Shiga-ken, an owner of a mine in that area. As it can be speculated that among ores throughout the world there would be an ore substantially equal in composition to the Inoue ore, it can be noted herein that the present invention can use an ore other than the Inoue ore as long as it can radiate neutrons or gamma-rays in substantially the same manner as the Inoue ore.

It is confirmed by tests for measurement of the magnitude of radioactive rays by Frontier Science Research Laboratory of Osaka Prefectural University that the Inoue ore spontaneously radiates radioactive rays in a very minute magnitude that is somewhat lower than the acceptable magnitude that can be allowable from the viewpoint of human health. These tests were carried out over a period of time ranging from Sep. 30 to Oct. 2, 1996 by using a Ge (Li) semiconductor detector and a wave height analyzer as instrument devices in such a manner that 200 grams of a sample made from sand of the Inoue ore was tightly attached to the instrument devices. As a result of measurement, the sample was found to emit radioactive rays in magnitude as follows:

$^{232}$Th ($^{204}$Tl) at the rate of 175±10 Bq/kg (alpha decay);

$^{226}$Ra ($^{227}$Ac) at the rate of 184±11 Bq/kg (beta decay); and $^{226}$Ra ($^{214}$Bi) at the rate of 301±10 Bq/kg (beta decay);

where Th is thorium; Tl is thallium; Ra is radium; Ac is actinium; and Bi is bismuth.

The first result indicates the radioactive rays emitted by the alpha decay; and the second and third results indicate both the radioactive rays emitted by the beta decay. As neutrons are emitted by the beta decay in a large amount that cannot be comparable with the alpha decay, it is considered that the present invention utilizes these neutrons. Moreover, there are naturally-occurring substances that radiates gamma-rays, and it is also considered that the gamma-rays can exhibit a variety of effects together with the neutrons. It is also confirmed that the Inoue ore is radiating the gamma-rays in the amount larger by several times to several hundreds times than usual substances which occur naturally. It is stipulated that those gamma-rays are closely associated with the useful effects as will be described hereinafter because the tendency can be recognized that the larger the amount of the radiated gamma-rays is, the higher the effect is and vice versa.

Although it is reported by an American scientist in an article relating to reduction in exhaust emission and improvements in fuel economy by irradiation of fuel with X-rays, it is now noted, however, that it is almost impossible to continue irradiating fuel with X-rays all the time. If it would be possible, expenses required for commercialization should become extraordinarily high and prices of a resulting product should become higher by several hundreds times the actual price of fuel. For those reasons, tests have so far been conducted merely as experiments. Recent studies, however, have revealed that X-rays having the wavelength of $10^{-13}$ cm are equal to the gamma-rays having the wavelength of $10^{-10}$ cm to $10^{-12}$ cm, so that the experiment has been carried out for an ore capable of emitting gamma-rays having the equal wavelength. As a result, the experiment has recorded an unbelievable figure that fuel efficiency has been improved higher by 43% at the most for a diesel engine having displacement of 2,000 cc. Following the experiment, a similar result has further been confirmed by tests (status of various roads and various carrying capacities) using an actual car on a public road. From the foregoing results, the present invention has been applied for patent. Further results have been gained in that black smoke discharged until then has been rapidly reduced and NOx and SOx have also been reduced to a great extent by installing a thing coated with a paint containing the Inoue ore in the vicinity of an air intake tube (an air cleaner portion). In this case, it is considered that nitrogen (N) in air is converted into carbon (C) and hydrogen (H) and the converted elements are caused to react with fuel thereby leading to complete combustion and as a result reducing the amounts of NOx and SOx to a great extent.

Although the chemical element conversion substance to be used for the present invention basically contains the Inoue ore as described above, it may also be used any other ore in combination with the Inoue ore or as a substitution for the Inoue ore, which can radiate neutrons or gamma-rays in substantially the same manner as the Inoue ore.

The fuel improving method according to the present invention comprises introducing fuel such as gasoline, light oil or the like into a liquid passageway in which the chemical element conversion substance containing an ore radiating neutrons or gamma-rays spontaneously is disposed, and irradiating the fuel flowing through the liquid passageway with radioactive rays.

In order to enhance the effects to be achieved by the method according to the present invention, it is preferred that plural kinds of the chemical element conversion substance having different magnitude of radiation and different amounts of radioactive rays be disposed along the liquid passageway in series and fuel flowing therethrough is irradiated with the various kinds of radioactive rays having different magnitude in sequence.

The fuel improving apparatus according to the present invention comprises the chemical element conversion substance disposed in a fuel supply passageway of an internal combustion engine. More specifically, it is proposed as a practically available and economic embodiment that the chemical element conversion substance is disposed in the casing of a fuel strainer of the fuel supply passageway.

In order to enhance the effects to be achieved by the apparatus according to the present invention, it is preferred that plural kinds of the chemical element conversion substance having different magnitude of radiation and different amounts of radioactive rays be disposed in series along the fuel supply passageway of the internal combustion engine.

The present invention provides the fuel improving method and apparatus, which utilize the action and effects specifically achieved by the Inoue ore or any other ore that can radiate neutrons or gamma-rays spontaneously, so that the present invention can exhibit the extremely great effects in improving fuel efficiency and purifying exhaust emission.

BEST MODES FOR CARRYING OUT THE INVENTION

Figure 1:
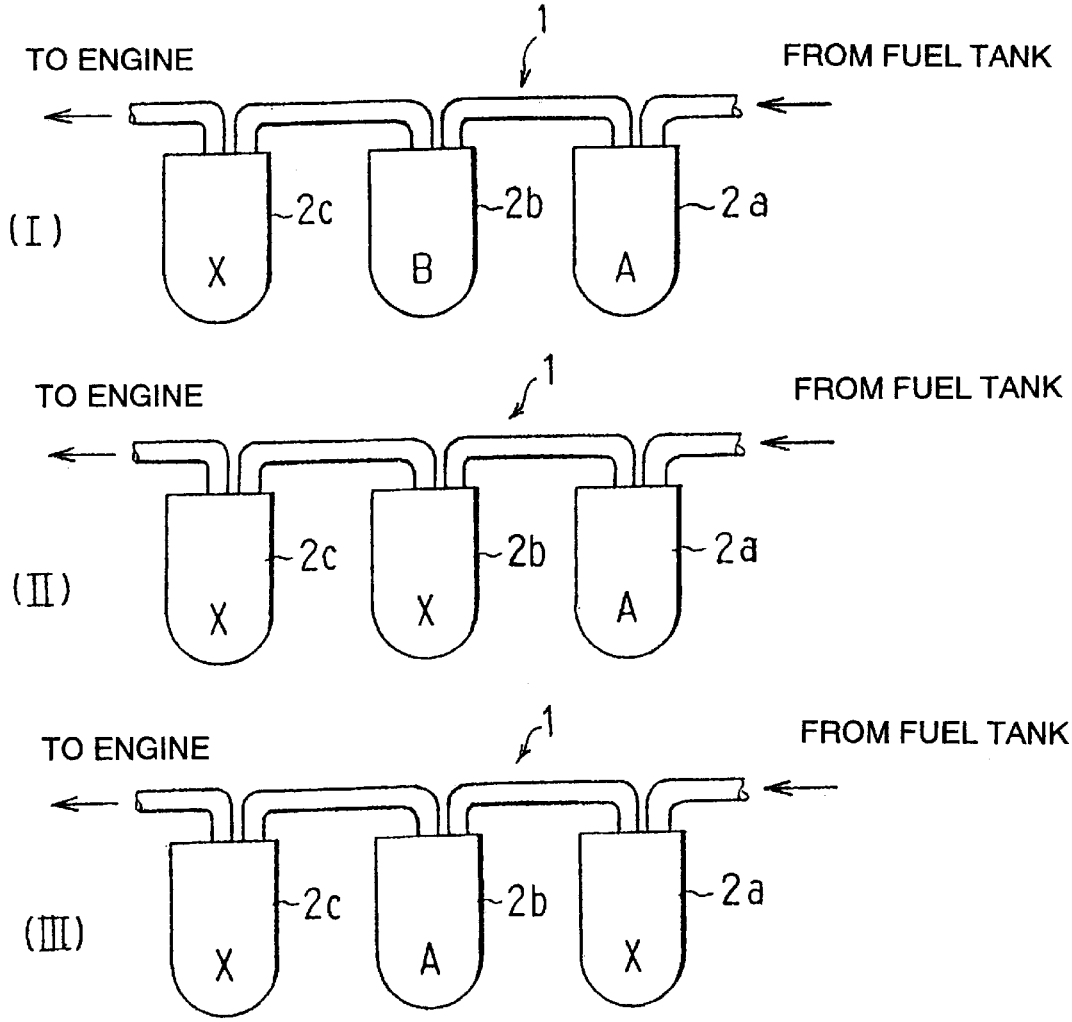
FIGS. 1(I), (II) and (III) are each an abridged side view showing a fuel improving apparatus according to the present invention.

The Inoue ore produced in Nango of Seta River at the southernmost part of the Lake Biwa is well known in the related industry sectors and is used as a raw material for glaze of porcelain to such an extent to which it amounts to 80% or more in the market share throughout Japan.

Surprisingly, the present inventor has for the first time confirmed that the Inoue ore has the astonishing action and effects that so far have never been known to any one. The superior action and effects are so amazing that, among exhaust gases discharged from an internal combustion engine of a vehicle including an automobile, carbon monoxide (CO), carbon dioxide ($CO_2$), hydrocarbons (HC), nitrogen oxides (NOx), black smoke and so on can be reduced at rates as high as 90% to 100% and that the fuel efficiency can be improved in usual conditions by 10% to 60% and in a special case by 100% or higher.

The present inventor has made extensive reviews about the causes of the amazing action and effects achieved by the Inoue ore. As a result, the present inventor has come to the thought that minute amounts of neutrons or gamma-rays radiated from the Inoue ore might be the main cause. It is physically known that the neutrons and gamma-rays can react with various chemical elements and cause a reaction with an atomic nucleus. Therefore, the present inventor has put forward the thought as a hypothesis that among the reactions of the neutrons or gamma-rays, the reaction of conversion into carbon and hydrogen would be mainly caused to occur by the action of the neutrons on nitrogen in air. As a result, the present inventor has found that this hypothesis can conform with various phenomena caused actually by the Inoue ore at a high probability and it can be explained to an almost full extent scientifically. From the foregoing background, research on application of this technology has been extensive made on the basis of this scientific knowledge. The invention achieved by the results obtained by the research has been applied for patent as Japanese Patent Application No. 9-64,833.

The present invention is the result of further studies on practical application of the invention as claimed in the previous patent application. The present invention comprises irradiating fuel such as gasoline, light oil or the like with neutrons or gamma-rays in varying amounts of radioactive rays in sequence. This has been found to achieve the greater effects in improvements of fuel efficiency and purification of exhaust emission than when fuel is irradiated with neutrons or gamma-rays in a constant amount.

A description will be made of an embodiment according to the present invention with reference to the accompanying drawings. FIGS. 1(I) to (III) schematically show three types of fuel improving apparatuses according to the present invention. As shown in FIG. I, reference numeral 1 stands for a fuel supply pipe (liquid passageway) for supplying gasoline, light oil or the like to an engine from a fuel tank. The fuel supply pipe 1 is provided with fuel strainers 2*a*, 2*b* and 2*c* in its intermediate position. For an automobile of a usual type, only one fuel strainer is disposed; however, the present invention is provided with three fuel strainers. As specifically shown in FIG. 2, each of the fuel strainers 2*a*, 2*b* and 2*c* is configured such that it comprises a closed casing 3 in the form of a longitudinal cylinder and a strainer pipe 4 fixed at the center of the casing 3. The strainer pipe 4 is configured such that its bottom end portion is closed with a small-mesh material or a porous material and it is fixed to a diaphragm plate 5 at an upper portion in the casing 3 in a spaced relationship slightly apart from the bottom portion of the casing 3. On top of the strainer pipe 4 is connected a fuel supply pipe 1*b* leading to the engine.

Between the diaphragm plate 5 and an upper casing wall 3*a* is formed a distribution chamber 6, and the fuel supply pipe 1*a* communicating with the fuel tank is connected to an inlet 7 formed in the upper casing wall 3*a*. The diaphragm plate 5 is provided with a plurality of distribution holes 8 in its peripheral direction at an equally spaced relationship. The distribution holes 8 connect the casing 3 disposed below the diaphragm plate 5 to the distribution chamber 6.

On the bottom inside the casing 3 are placed four packs of rock granules, each pack 11 of rock granules containing about 50 grams of granulated rock 9 packaged in a bag made of non-woven cloth 10. The granulated rock 9 contained in the pack 11 comprises an ore (a chemical element conversion material) spontaneously radiating neutrons or gamma-rays. More specifically, the ore is so called "Inoue Ore" produced in a region in the vicinity of Nango of Seta River at the southernmost of the Lake Biwa, and is a kind of granite that can spontaneously radiate neutrons or gamma-rays.

The number of neutrons radiated from the rock 9 may vary to some extent with the area of production or the depth of production even if the ore is identically called the Inoue ore. The ores may be varied from an ore which radiates about 500 counts per minutes although the estimated amount of deposits is large to an ore which can radiate as large as 700 counts to 1,000 counts per minute although the estimated amount of deposits is relatively small. For brevity of description, the former ore, i.e., an ore radiating a relatively lesser number of neutrons, is referred to herein as "Rock A" and the latter ore, i.e., an ore radiating a relatively larger number of neutrons, is referred to herein as "Rock B". Further, there is a certain kind of the Inoue ore or another ore in the world that can radiate neutrons at the rate of about 4,000 counts per minute or more, although the estimated amount of deposits is extremely small, and this kind of ore is referred to herein as "Rock X".

Figure 2:
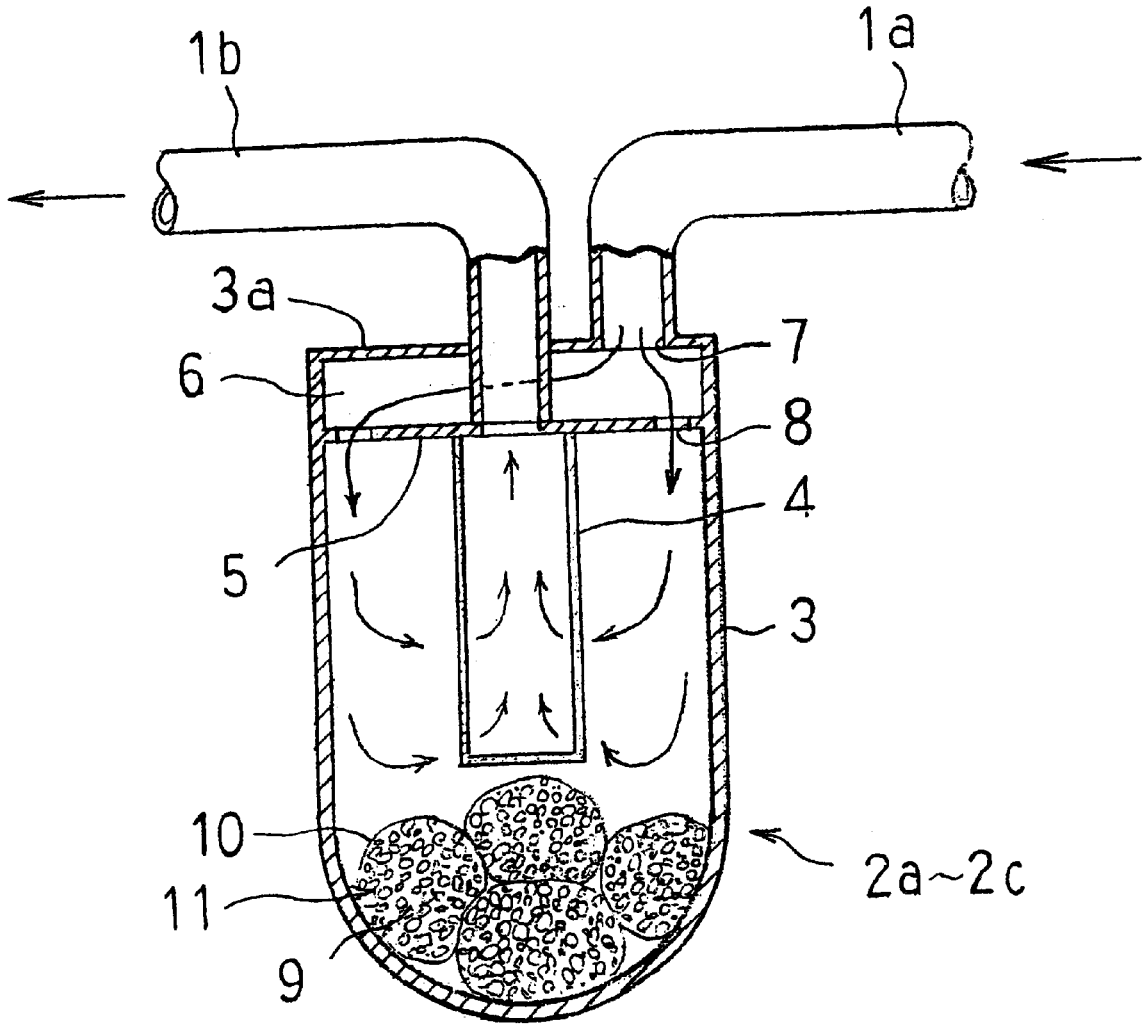
FIG. 2 is a sectional view showing a fuel strainer.

In FIG. 1(I), three fuel strainers 2*a*, 2*b* and 2*c* are disposed in this order from the upstream side to the downstream side, and the fuel strainers 2*a*, 2*b* and 2*c* are filled each with four packs 11 of Rock A, Rock B and Rock X, respectively. In FIG. 1(II), the three fuel strainers 2*a*, 2*b* and 2*c* disposed in the same manner as above are filled each with four packs 11 of Rock A, Rock X and Rock X, respectively. Moreover, in FIG. 1(III), the three fuel strainers 2*a*, 2*b* and 2*c* disposed in the same manner as above are filled each with four packs 11 of Rock X, Rock A and Rock X, respectively. It is to be noted herein that, although no specific description is made herein of the test results for the types of the apparatus as indicated in FIGS. 1(II) and 1(III), the test results for improvements in fuel efficiency and purification of exhaust emission are found better for the type as shown in FIG. 1(II) than for the type as shown in FIG. 1(I) and further better for the type as shown in FIG. 1(III) than for the type as shown in FIG. 1(II). It will be found from those test results that irradiation with neutrons (or gamma-rays) by the largest possible difference of radiation can contribute to improvements in fuel to a greater extent.

The fuel improving apparatus according to the present invention is configured in the construction as described above, and fuel such as gasoline, light oil or the like flown from the fuel tank is subjected to irradiation in sequence with neutrons or gamma-rays radiating from the Rocks A, B and X while it passes through the fuel strainers 2*a*, 2*b* and 2*c*. The intensity of radiation (the amount of radioactive rays) by the neutrons in this case ranges from high (Rock A), low (Rock B), and highest (Rock X). The theory is not elucidated scientifically yet to a sufficient extent. Now, a description will be made of the effects of the present invention upon improvements in fuel efficiency for an engine which is fed with fuel through the fuel improving apparatus of FIG. 1(I) and upon the amount of the NOx emission, on the basis of the test results as indicated in FIGS. 3 to 8, inclusive.

Figure 3:
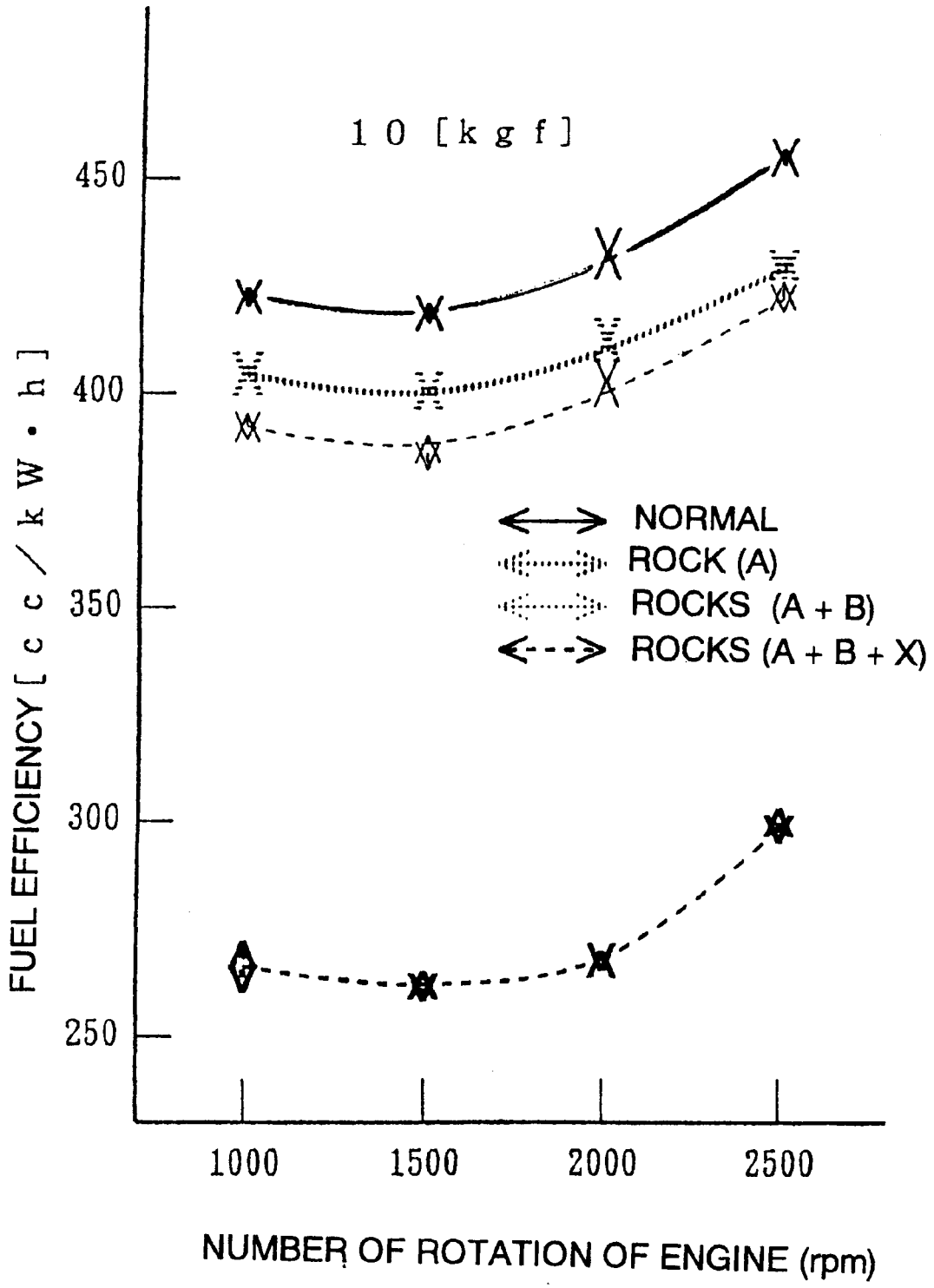
FIG. 3 is a graph showing the results of a test for fuel efficiency, which has been carried out at the engine load of 10 kgf.

FIGS. 3 to 8 indicate each test results for fuel efficiency carried out at the engine load of 10 kgf, 15 kgf, 20 kgf and 25 kgf, respectively. Each graph as shown in FIGS. 3 to 8 indicates the number of rotation of the engine as an X-axis and fuel efficiency (in cc/kW·h) as a Y-axis. In FIG. 3, the top graph indicates the results for a conventional engine which does not use a fuel improving apparatus (as referred to as "NORMAL"), while the bottom graph indicates the results for an engine which uses the fuel improving apparatus according to the present invention. As a reference, the second top graph indicates the case where Rock A is used for one fuel strainer, and the third top graph indicates the case where Rock A and Rock B are used, respectively, for two fuel strainers disposed on the upstream side.

As is apparent from the graphs of FIG. 3, it was found that the bottom graph shows the highest fuel efficiency by the engine using the fuel improving apparatus where Rocks A, B and X were disposed in this order.

Figure 4:
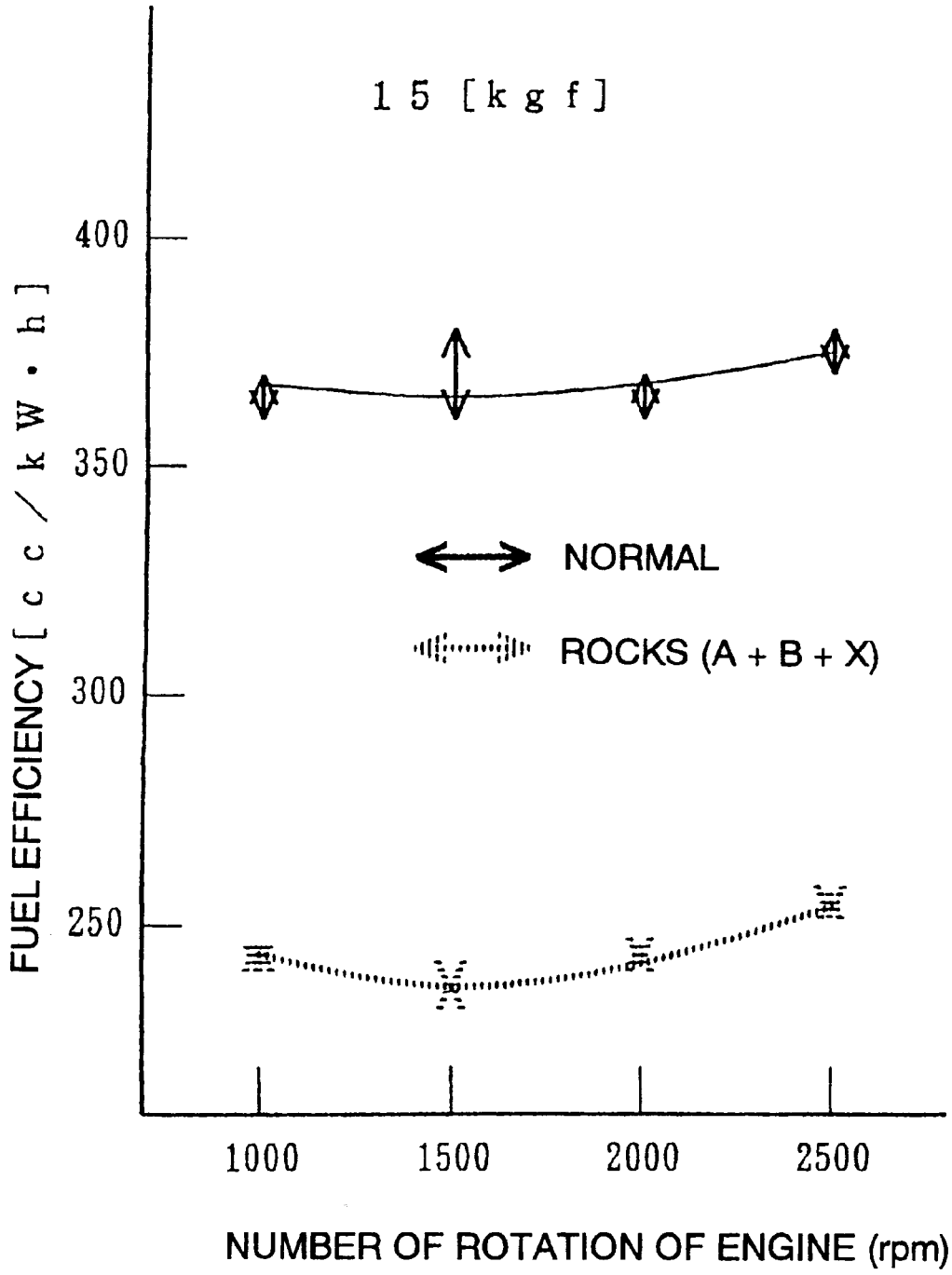
FIG. 4 is a graph showing the results of a test for fuel efficiency, which has been carried out at the engine load of 15 kgf.
Figure 5:
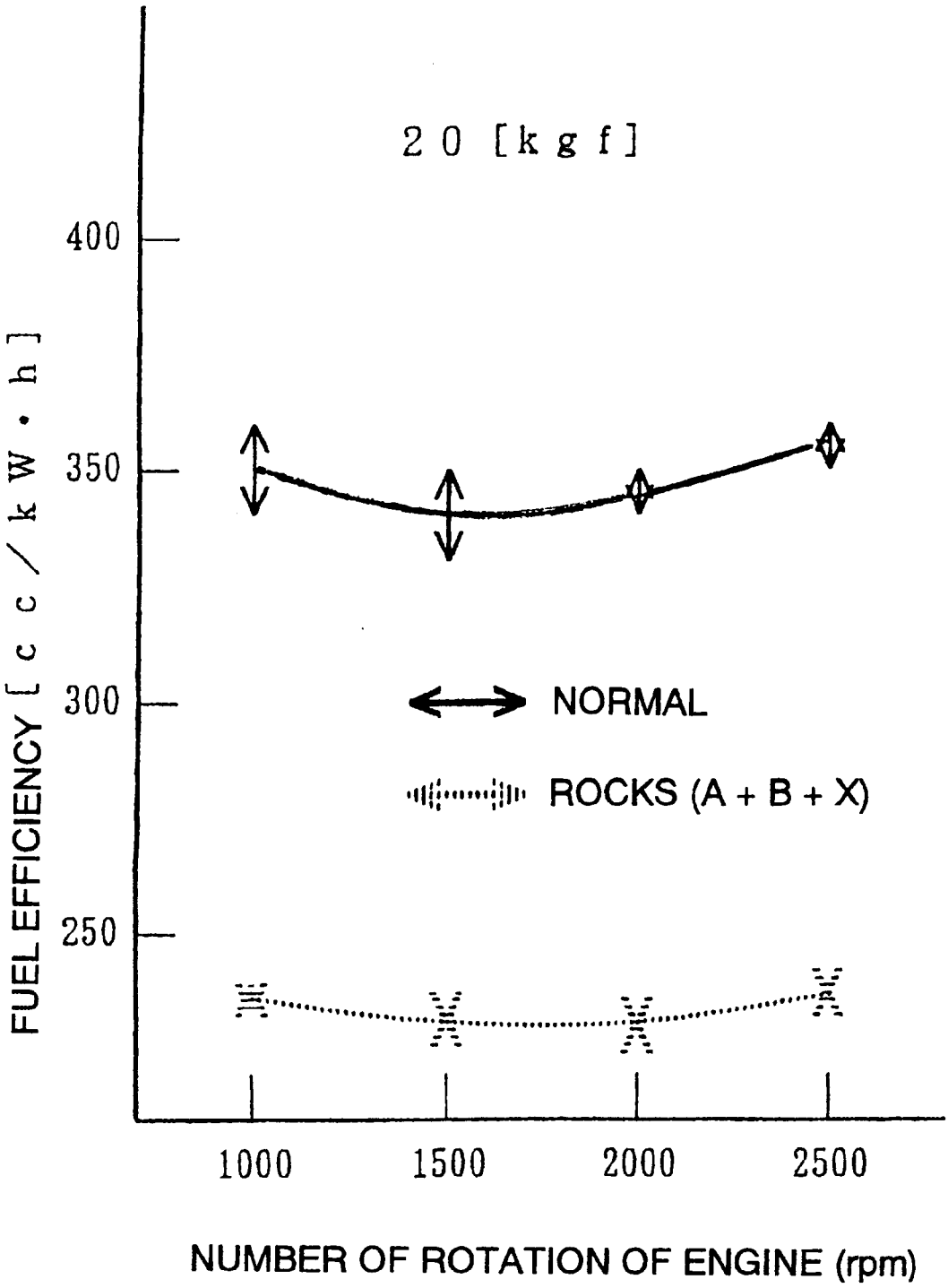
FIG. 5 is a graph showing the results of a test for fuel efficiency, which has been carried out at the engine load of 20 kgf.
Figure 6:
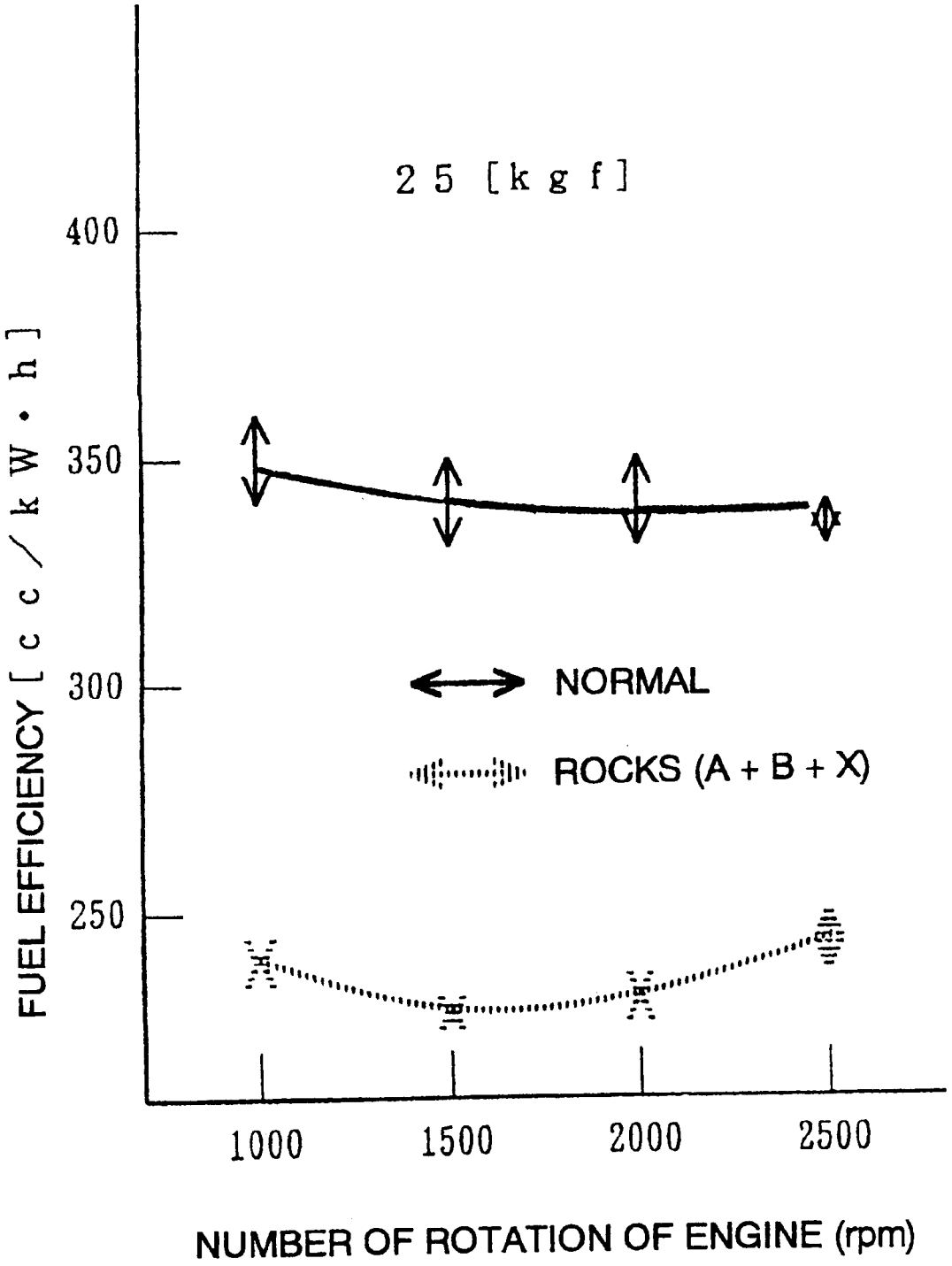
FIG. 6 is a graph showing the results of a test for fuel efficiency, which has been carried out at the engine load of 25 kgf.

FIGS. 4 to 6 show comparisons of the fuel efficiency for an engine having no fuel improving apparatus installed therein with the fuel efficiency for an engine having the fuel improving apparatus installed therein where Rocks A, B and X are used. In each figure, it was found that the engine with the fuel improving apparatus installed therein differs in the fuel efficiency to a great extent from the engine with no fuel improving apparatus installed therein, although the difference varied to some extent.

Figure 7:
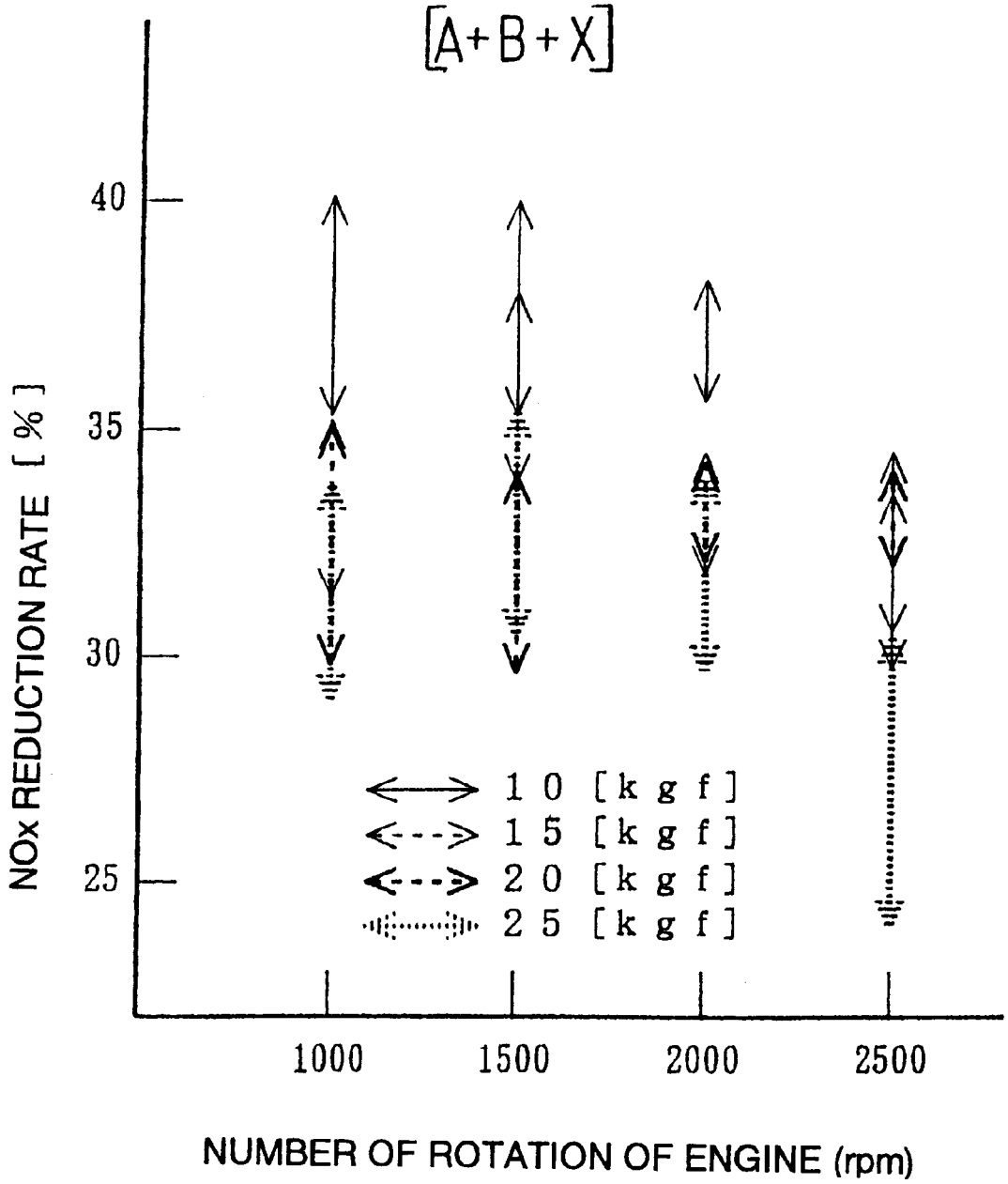
FIG. 7 is a graph showing the result of measurement for a rate of reduction in NOx.

FIG. 7 indicates rates of reduction in NOx when a fuel improving apparatus with Rocks A, B and X filled therein is used for an engine. Generally, the amount of NOx discharged therefrom is larger when the engine load is smaller, for example, during idling, than when the engine load is higher. As is apparent from this figure, it was found that the larger rate of reduction in NOx can be gained when the engine load is lower. It is also confirmed that the amounts of CO, $CO_2$, HC, black smokes, and so on to be discharged from the engine can be reduced to a great extent.

Figure 8:
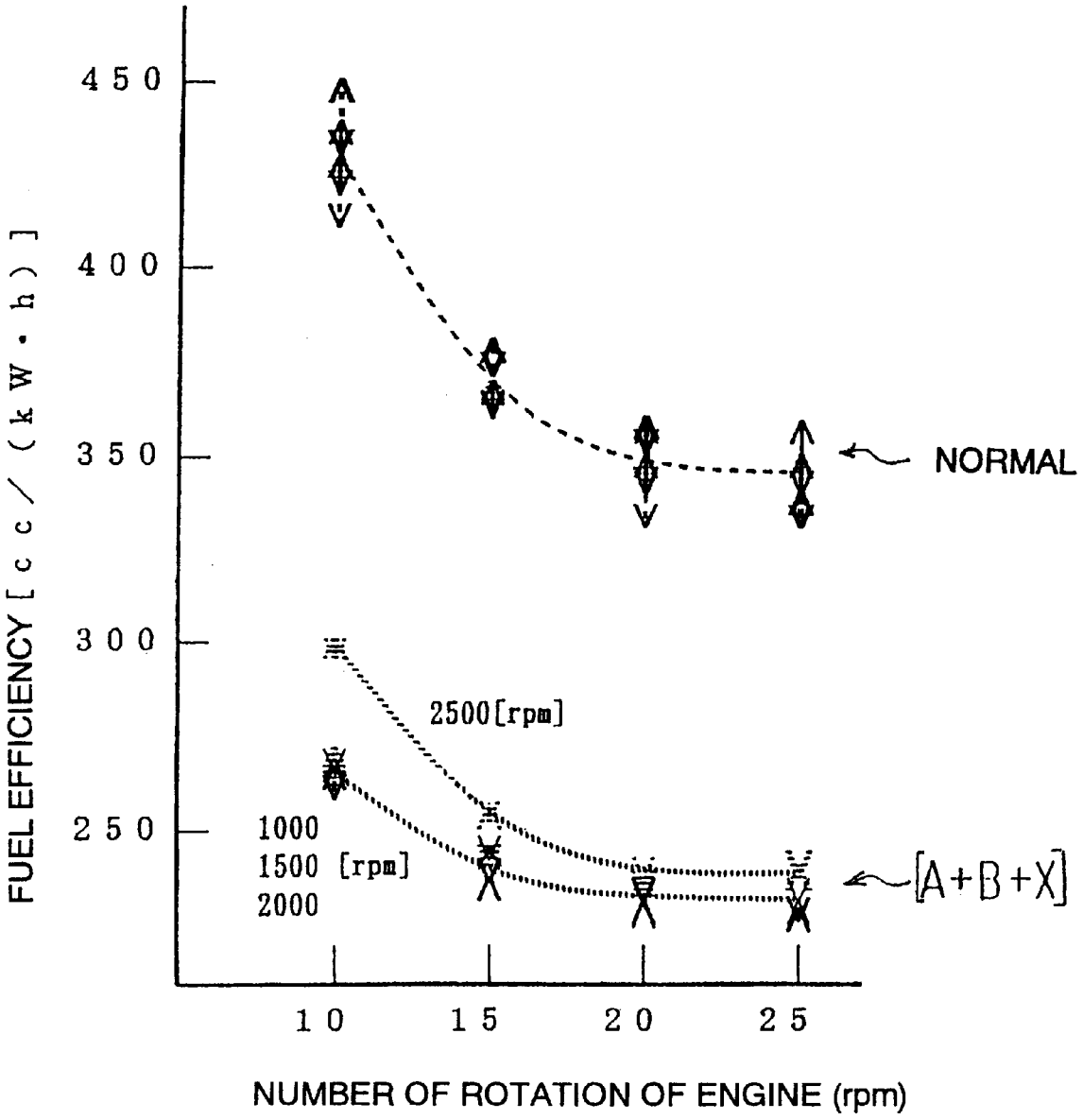
FIG. 8 is a graph showing the results of a test for fuel efficiency, which has been carried out by varying the engine load and the number of rotation of the engine.

The rate of consumption of fuel is relatively poorer when the engine load is small such as, for example, during idling. However, it is confirmed that the fuel improving apparatus according to the present invention can improve the rate of consumption of fuel to a greater extent than a conventional engine, as shown in FIG. 8.

It should be noted herein that the present invention is not limited to application to only an engine using gasoline, light oil or other fuel and that it can be applied to a fuel supply passageway of an engine using LPG as for a taxi cab or other vehicles. It is also confirmed that higher results for improvements in fuel efficiency and purification of exhaust emission can be achieved for use with LPG vehicles than with gasoline vehicles, although the reasons are not known yet.

It is further confirmed that the chemical element conversion substance for use in the present invention can gain the high effects for improvements in fuel efficiency and purification of exhaust emission by locating the chemical element conversion substance in a fuel supply system of an internal combustion engine, as described above. It is considered, however, that a synergistic effect can be achieved by locating the chemical element conversion substance according to the present invention in a system such as, for example, an intake system or a cooling water system, other than the fuel supply system.

In the above embodiment of the present invention, the rock 9 acting as the chemical element conversion substance is disposed in the fuel strainer. It is to be noted herein, however, that the rock 9 can be used, in place of locating the rock 9 inside the fuel strainer, by pulverizing the rock 9 into powder, mixing the powder with a paint, and coating the inside of each of the casings 3 with the paint or by providing a portion of the fuel supply passageway for a compartment for exclusive use with rocks, dividing the compartment into plural sections, and filling each of the plural sections with plural kinds of the rock 9 having different magnitude of radiation.

In the above embodiment of the present invention, three of the fuel strainers 2*a* to 2*c* are located. From the actual and economic point of view, however, only one fuel strainer can be located and the rock 9 as the chemical element conversion substance having a relatively high amount of radioactive rays can be filled in the fuel strainer.

What is claimed is:

1. A fuel improving method wherein a chemical element conversion substance containing an ore spontaneously radiating neutrons or gamma-rays is divided into plural kinds having different magnitude of radiation, each of the plural kinds of the chemical element conversion substance is disposed in series along a fluid passageway; fuel such as gasoline, light oil is supplied to flow through the fluid passageway; and the fuel flowing through the fluid passageway is irradiated in turn with radioactive rays of different magnitude of radiation.

2. A fuel improving apparatus wherein plural kinds of the chemical element conversion substances, as claimed in claim 1, having different magnitude of radiation in varying amounts of radioactive rays are disposed in series along a fuel supply passageway of an internal combustion engine.

* * * * *